US005412373A

United States Patent [19]

Wajda

[11] Patent Number: 5,412,373

[45] Date of Patent: May 2, 1995

[54] WALLET SECURITY DEVICE

[76] Inventor: Robert G. Wajda, 4415 17th Ave., Parkersburg, W. Va. 26101

[21] Appl. No.: 294,807

[22] Filed: Aug. 25, 1994

Related U.S. Application Data

[63] Continuation-in-part of Ser. No. 52,529, Apr. 29, 1993.

[51] Int. Cl.[6] ..... G08B 13/189

[52] U.S. Cl. ..... 340/571; 340/568

[58] Field of Search ..... 340/571, 568

[56] References Cited

U.S. PATENT DOCUMENTS

| | | | |
|---|---|---|---|
| 3,930,349 | 12/1975 | Steck et al. | 340/571 |
| 3,959,789 | 5/1976 | McGahee | 340/568 |
| 4,692,745 | 9/1987 | Simanowitz | 340/571 |
| 4,755,802 | 7/1988 | Urbanczyk | 340/568 |
| 5,005,111 | 4/1991 | Teal | 150/102 |
| 5,153,561 | 10/1992 | Johnson | 340/571 |
| 5,281,195 | 1/1994 | Torres et al. | 340/571 |

*Primary Examiner*—Glen Swann
*Attorney, Agent, or Firm*—Richard Litman

[57] ABSTRACT

A wallet security device detects when a wallet has been lifted from a user's pocket or purse. If the device is enabled, the device sounds an alarm after a predetermined period of time has elapsed since the wallet was removed from the pocket or purse of the user if a disarm code is not entered onto a keypad located within the wallet within that predetermined period of time. A photodetector located on the outside of the wallet is used to detect when the wallet is removed from the pocket or purse of the user. If the photodetector detects light, the device assumes that the wallet has been removed and, if the disarm code is not entered within the predetermined period of time or if a code is entered onto the keypad that the device does not recognize as a valid disarm code, the alarm is activated. Once the disarm code is entered, the alarm device is deactivated until the arm code is entered again.

6 Claims, 4 Drawing Sheets

WALLET SECURITY DEVICE

CROSS-REFERENCE TO RELATED APPLICATIONS

This application is a continuation-in-part of Ser. No. 08/052,529, filed Apr. 29, 1993.

BACKGROUND OF THE INVENTION

1. Field of the Invention

The present invention relates to a wallet security device for sounding an alarm if the wallet is stolen. More particularly, the present invention relates to such a wallet security device which activates an alarm after a predetermined amount of time has elapsed from the time the wallet was removed from the pocket, purse, or similar enclosure of the user unless a code is entered into the device shortly thereafter.

2. Description of the Prior Art

U.S. Pat. No. 3,930,249 issued Dec. 30, 1975 to Howard A. Steck et al. discloses a wallet security device including a photodetector. Upon removing the wallet from the pocket, when the photodetector is exposed to light, an alarm sounds.

U.S. Pat. No. 3,959,789 issued May 25, 1976 to Francis M. McGahee discloses a credit card monitoring device having a plurality of switches, each held open when in contact with one of the credit cards located therein. When one of the credit cards is removed, the switch associated therewith is closed so as to activate a timer connected to an alarm. The timer then activates the alarm upon the expiration of a predetermined period of time.

U.S. Pat. No. 4,692,745 issued Sep. 8, 1987 to Solly Simanowitz discloses a credit card alarm device for a wallet having a plurality of switches, each associated with one credit card, and each located in parallel with one another. The parallel switches are in series with a photodetector switch which is closed when no light is detected, a power source, and an alarm. The alarm is activated when the photodetector detects no light, such as when the wallet is closed, and one of the credit cards has not been returned to the wallet.

U.S. Pat. No. 4,755,802 issued Jul. 5, 1988 to Felix Urbanczyk discloses an alarm device attachable to an article carrier, such as a briefcase or handbag. The alarm device is activated when the carrier is completely opened. If the carrier is only partially opened to allow a user to deactivate the alarm device contained therein before the carrier is completely opened, the sounding of the alarm is avoided.

U.S. Pat. No. 5,005,111 issued Apr. 2, 1991 to Chuck Teal discloses an alarm device utilized in a purse and which is activated after a preset amount of time from opening the purse unless the alarm is deactivated.

U.S. Pat. No. 5,153,561 issued Oct. 6, 1992 to Eric S. Johnson discloses a container having a lid removably attached thereto. The lid includes a lock which can only be opened when a set code entered from a keypad located on the lid is entered.

None of the above inventions and patents, taken either singly or in combination, is seen to describe the instant invention as claimed.

SUMMARY OF THE INVENTION

The wallet security device of the present invention is designed to be attached to a foldable wallet or the like. The security device includes a flexible circuit board, a flexible data bus, and a flexible keypad attached to one end of the flexible data bus for entering in data to the circuitry on the circuit board attached to the other end of the flexible data bus. The circuit board is located at one end of the wallet with its front facing the outside of the wallet and is back to back with the keypad whose front face is located on the inside of the wallet.

The flexible circuit board includes a power source, a photodetector, a programmable code verification chip, a controller circuit, an alarm driver, and a buzzer. The flexible circuit board is placed inside the wallet so that the buzzer and photodetector face an outside portion of the wallet enabling the photodetector to pick up ambient light and the buzzer to be heard when activated. The flexible keypad is located adjacent the flexible circuit board.

When in operation, once the device is turned on, the device enters the arm mode. Once in the arm mode, if the wallet is placed inside a pocket, purse, or similar enclosure so that no light is detected by the photodetector, once the wallet is removed and the photodetector is again exposed to light, the alarm sounds after a predetermined amount of time has elapsed since the photodetector first detected the light upon the removal of the wallet unless the disarm code is entered onto the before the time expires. Thus the user must open the wallet and enter the correct disarm code on the keypad before the time expires or the alarm sounds. Once the device has been disarmed, the arm code must be re-entered onto the keypad or the alarm device will be deactivated.

Accordingly, it is a principal object of the invention to a wallet security device which, when armed, will sound an alarm after a predetermined amount of time has elapsed once the wallet has been removed from the pocket, wallet, or similar enclosure of the user, unless a predetermined disarm code known by the user is entered onto a keypad.

It is another objective of the invention to provide a photodetector on the outside of the wallet to initially detect light when the wallet is removed from an enclosure of the user so as to indicate to a controller circuit of the security device that the wallet has been removed from the enclosure of the user.

It is a further object of the invention to activate a buzzer after the device is armed and the predetermined amount of time has elapsed from the initial time that the photodetector first detects light if the disarm code is not entered onto the keypad within that predetermined period of time.

Still another object of the invention is to allow a user to maintain the security device in the disarm mode unless a arm code is entered, thereby allowing the user to disable the alarm feature when it is not convenient and to enable the alarm feature when the user feels that it is most advisable It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings. For example, a light is included on the keypad to indicate that the device is armed when lit, and is disarmed otherwise such that the buzzer will not sound even if the disarm code is not entered after the wallet is removed from the enclosure of the user.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
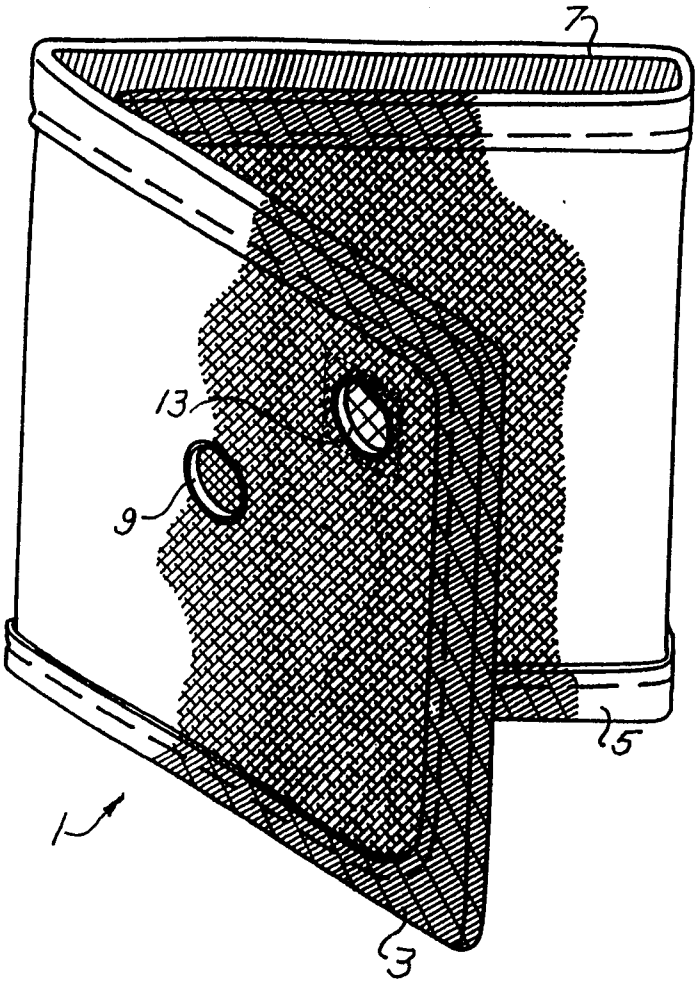
FIG. 1 is a perspective view of the outside of the wallet to be used with the wallet security device of the present invention.

The wallet 1 utilizing the wallet security device of the present invention is a trifold wallet or the like. One end section of the wallet 1 is folded over the opposite end section 5 of the wallet 1. Between the sections 3 and 5 of the wallet 1 is a middle section 7. The outside portion of section 3 includes a first hole to allow ambient light to be detected by photodetector 11, see FIG. 3, and a second hole 13 for allowing sound from a buzzer 15 to travel therethrough to the outside of the wallet 1.

Figure 2:
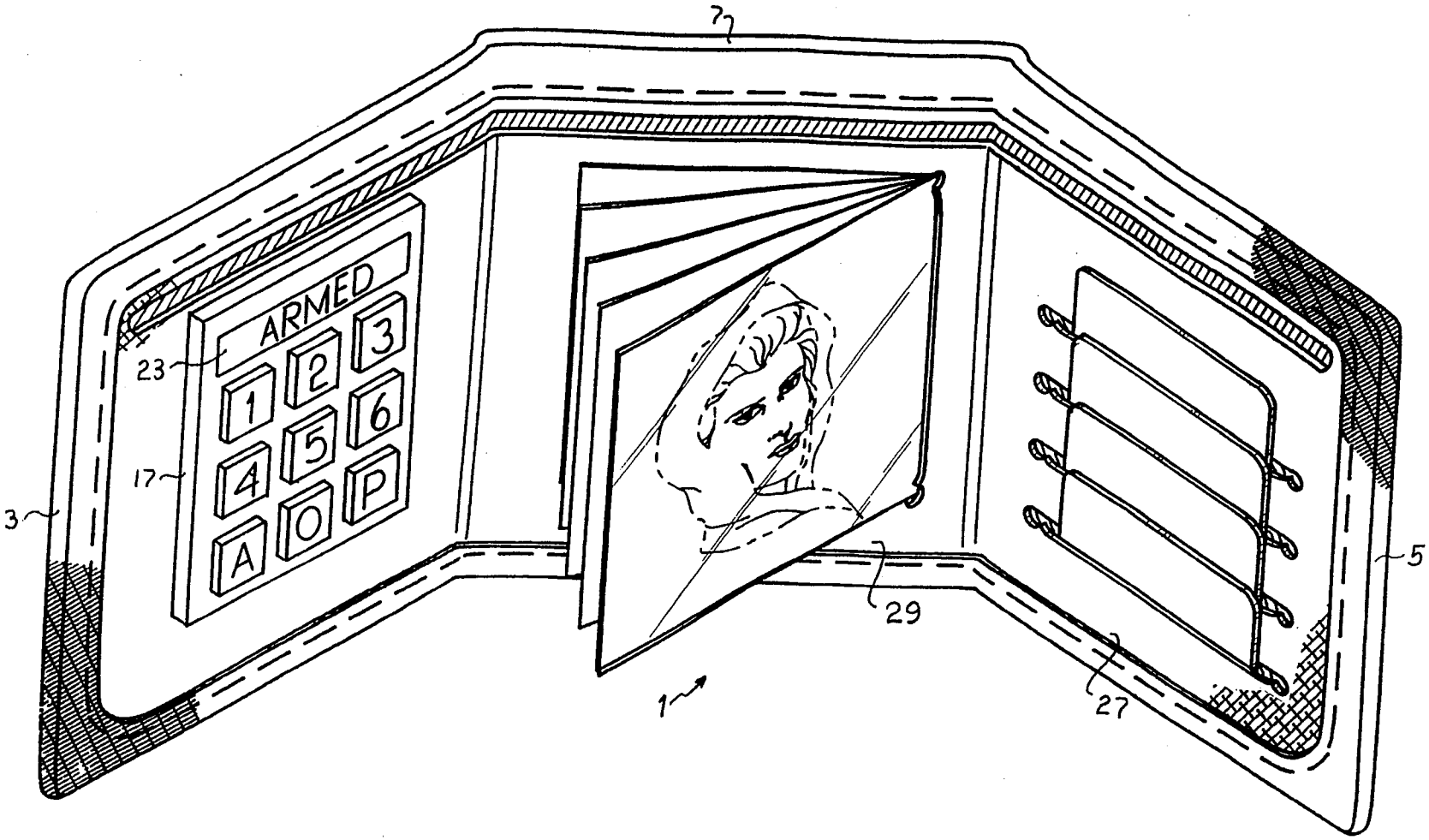
FIG. 2 is a perspective view of the inside of the wallet utilizing the wallet security device of the present invention.
Figure 3:
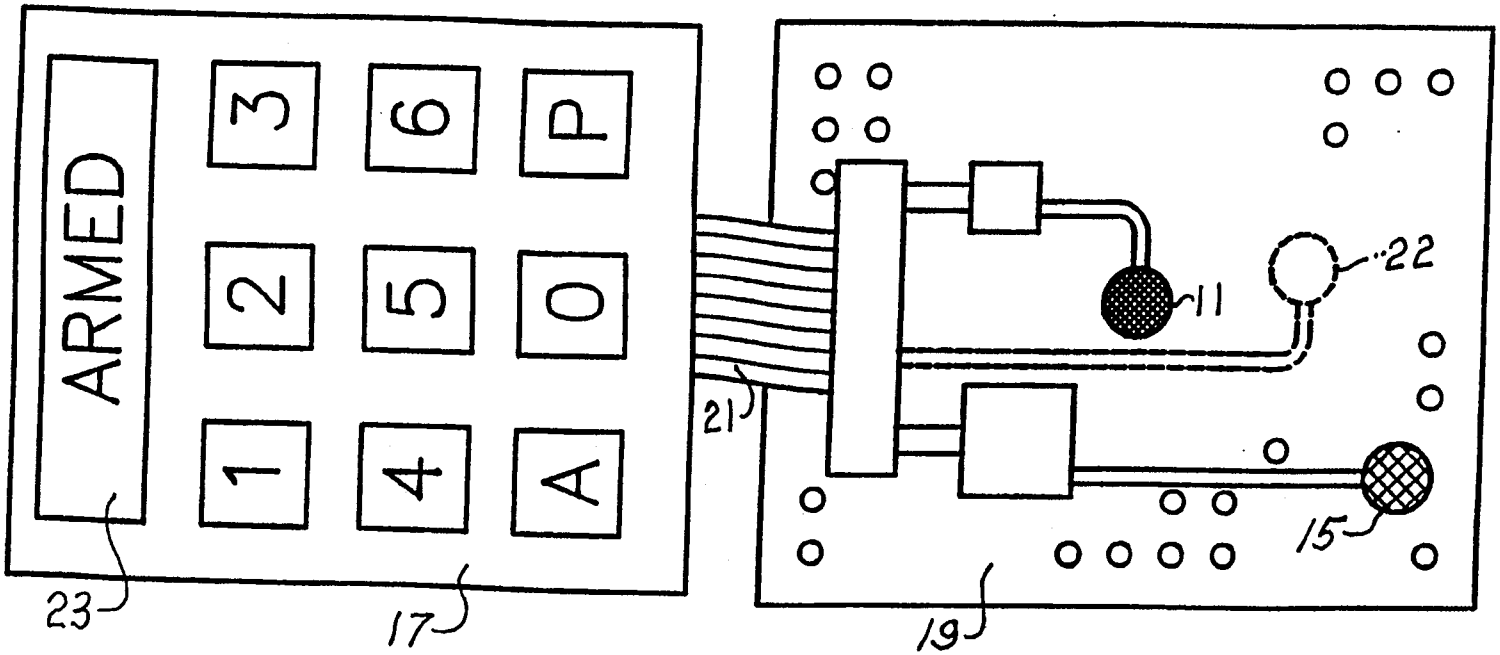
FIG. 3 is a top view of the flexible keypad and flexible circuit board of the present invention connected together by the data bus utilized in the wallet security device of the present invention.

As illustrated in FIG. 2, on the inside of the end 3 of the wallet 1, the face of a flexible keypad 17 is made accessible to the user. As shown in FIG. 3, the keypad 17 is connected to the circuit board 19 through the use of a data bus 21 to allow the user to enter the arm and disarm codes as discussed above. The data bus is flexible allowing the keypad 17 and the circuit board 19 to be placed back to back. Note that an "armed" light 23 is lit when the device is armed is off when the device is disarmed. The circuit board 19 includes on the front side thereof, the buzzer 15, photodetector 11, and the necessary controller circuitry including the digital lock circuit chip LS7222. On the back side of the circuit board 19 is a battery source 22. As shown in FIG. 2, the wallet 1 includes a credit card container section 27 and a photograph container section 29 located on the inside portion of the wallet 1.

Figure 4:
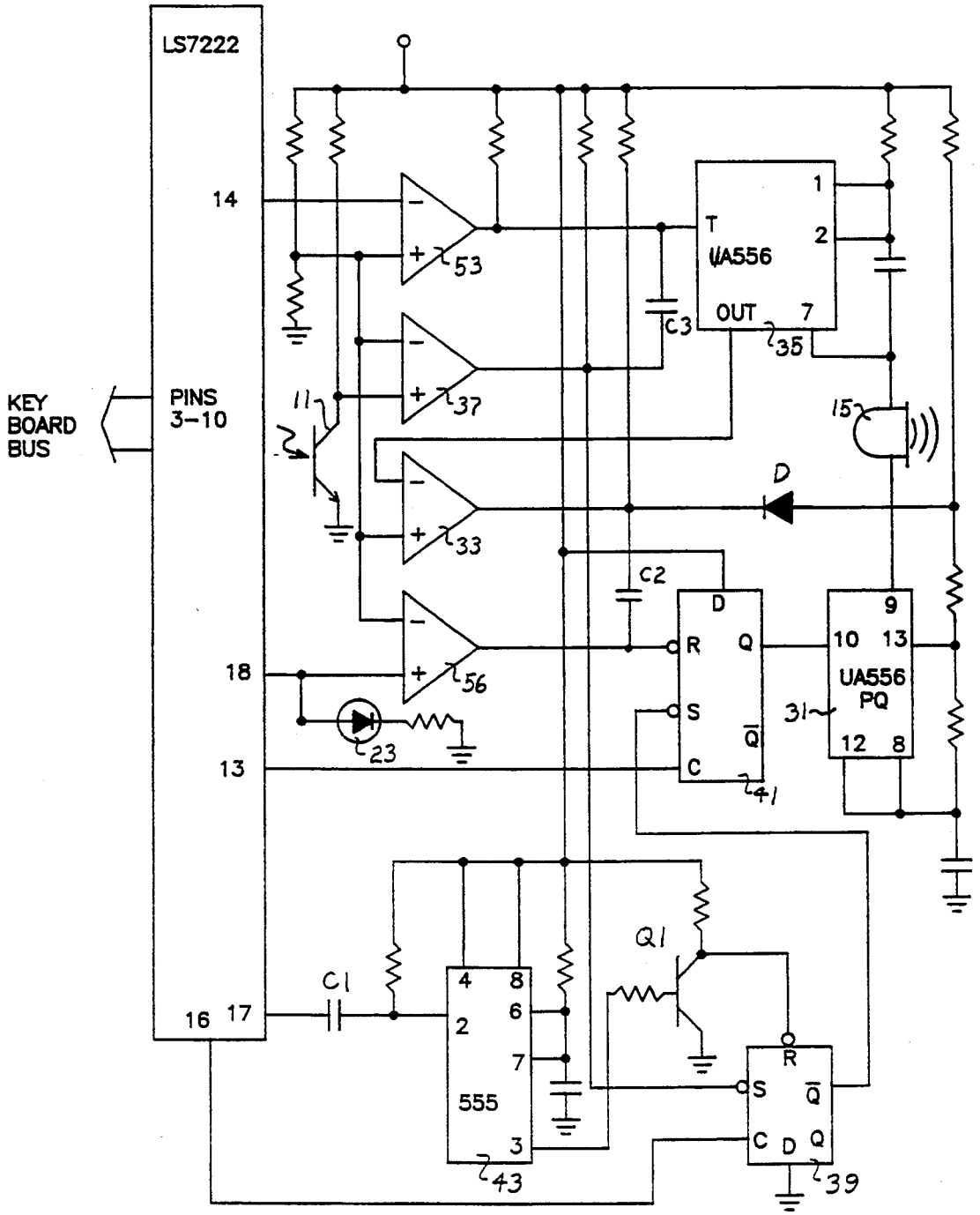
FIG. 4 is a schematic diagram of the circuitry involved with accomplishing the tasks of the present invention.

As shown in FIG. 4, the buzzer 15 is driven by tone generator 31. The tone generator 31 is a 556 chip used as an astable multivibrator and is enabled by its pin 10 as long as a ground connection is provided at the output of comparator 33. If the arm code is entered on the keypad 17 the output of pin 14 of the digital lock circuit chip LS7222 goes high momentarily and the output on pin 18 latches high, while the output on pin 17 latches low. The momentary pulse from pin 14 activates a timer 35 which is a 556 chip used as a one-shot.

After a predetermined period of time t1 passes since the timer 35 receives its last inverted pulse input without any other further input pulse received at the T terminal, the output of timer 35 goes high, allowing comparator 33 to provide a low output. Before the timer 35 times out and the output thereof goes high, if the photodetector 11 is detecting light, the photodetector 11 provides a ground connection to the positive input of a comparator 37, thereby allowing the output thereof to go low. In this manner the flip-flop 39 is set and the inverted output thereof is low, thereby setting flip-flop 41 so that the output thereof will enable the tone generator 31 to be activated by the flip-flop 41 once the timer 35 times out.

Pin 17 latches high as the LS7222 chip changes states from an disarmed status to an armed status. A pulse is fed to pin 2 of the timer 43 from the capacitor C1 located between pin 17 of the LS7222 chip and pin 2 of timer 43, which is a 555 timer, so as to activate the 555 timer 43. A predetermined amount of time t2 after being activated, timer 43 delivers an output pulse at pin 3 thereof which is inverted by transistor Q1 so as to reset the flip-flop 39. With both flip-flops 39 and 41, the reset terminals take priority over the set terminals; therefore, as long as the output of the photodetector 11 is absent after flip-flop 39 is reset, it will remain reset.

The predetermined time t2 is shorter than the predetermined time t1 and is the amount of time the user has to place the wallet back in his or her pocket in order for the alarm to remain deactivated. Once the timer 35 times out after the predetermined time t1 expires from the time the user first armed the device, the timer 35 delivers a pulse of a predetermined duration so as to activate the tone generator 31 as discussed above, if the photodetector 11 is still detecting light. Should the user close the wallet 1 before the predetermined amount of time t2 expires so as to prevent the photodetector 11 from setting the flip-flop 39 after the timer 43 has reset it as discussed above, then the inverted output of the timer 35 presented by the output of comparator 33 is used to reset the flip-flop 41. The pulse generated by the timer 35 is of a duration of a minute or so and determines how long the buzzer 15 remains activated. Since the lock status pin 18 of the LS7222 chip is high, the output of the comparator 56 is high and the LED 23 is on. The capacitor C2 located between the outputs of comparators 33 and 56 allows a negative pulse of a sufficient duration to reset the flip-flop 41 upon the leading edge of the pulse generated by timer 35 after being inverted and output by comparator 33.

In this manner, flip-flop 41 is reset at the beginning of the pulse generated by timer 35 and remains reset unless the flip-flop 39 failed to remain reset by the expiration of timer 43 upon the initial activation of the arm code by the user. Should the user retrieve the wallet after the arm code is set and put in a pocket or purse, the photodetector 11 delivers an inverted pulse to the input T of time 35 upon initially detecting light via the comparator 37 and capacitor C3 so as to activate the timer 35. The output of comparator 37 is low as long as light is being detected by the photodetector 11. This output is also fed to flip-flop 39 so as to set the same. Flip-flop 39 then sets flip-flop 41. Once the timer 35 times out to temporarily reset the flip-flop 41 and provide a ground to the diode D1, the flip-flop 39 again sets flip-flop 41 and activates tone generator 31 for as long as the pulse is delivered by the one-shot timer 35.

However, should the user enter the disarm code on the keypad 17, then the LS7222 chip will send a pulse to the C input of flip-flop 39 via disarm pin 16. The C input for both the flip-flops 41 and 39 allows the input from D to be latched when a pulse is received thereby. However, the next time the reset input of either flip-flops 41 and 39 is asserted when that flip-flop has been set, that flip-flop is reset irrespective of the D input. Likewise, the next time the set input of either flip-flops 41 and 39 is asserted when that flip-flop has a low output and is therefore reset, that flip-flop is set irrespective of the D input. Therefore, the C input only overrides the other inputs once, that is when it initially receives a pulse. Once the flip-flop 39 receives a pulse from disarm pin 16 after the user inputs the disarm code, the flip-flop 39 is reset since the D input thereof is grounded. Therefore, even if the photodetector is still receiving light so that the set terminal of the flip-flop 39 is asserted, the flip-flop 39 is reset via its C input upon receiving the disarm pulse.

Once the disarm code is entered on the keypad 17, the disarm pin 16 sends out a pulse as discussed above and the flip-flop 39 is reset. Also, the lock status pin 18 goes low and the unlock pin 17 goes high. With the lock status pin 18 going low, the comparator 56 outputs a ground indication, i.e. goes low. This in turn, resets flip-flop 41. As discussed above, flip-flop 39 is reset by its C input latching the ground connection from the D input, thus providing an unasserted input to the set terminal. However, should the flip-flop 39 be set by the photodetector as described above so as to present an asserted high input to the set terminal of the flip-flop 41, the flip-flop 41 will remain reset since the reset terminal thereof is asserted high by the lock status pin 18 of the LS7222 and takes priority over the set terminal when both are asserted. However, should the user enter an incorrect code while the device of the present invention is armed or disarmed, tamper pin 13 goes high momentarily so as to enable the C terminal of flip-flop 41 thereby latching the output of terminal D to the output thereof. Terminal D is latched to the power supply voltage and is therefore used to set the flip-flop 41 and activate the tone generator 31. When a disarm code is entered by the user, pin 16 goes high momentarily and pin 17 is latched high while the output of pin 18 latches low. Once the disarm code is entered as discussed above, the tone generator 31 is deactivated.

It is to be understood that the present invention is not limited to the sole embodiment described above, but encompasses any and all embodiments within the scope of the following claims.

I claim:

1. A portable personal article carrying security device attachable to a portable personal article carrier for either gender, the portable personal article carrier having an exterior portion and an interior portion, the interior portion thereof designed for transporting personal articles of the user therein, said portable personal article carrying security device comprising:

a keypad attachable to the interior portion of the portable personal article carrier;

a photodetector attachable to the exterior portion of said portable personal article carrier so as to be exposed to ambient light when the portable personal article carrier is exposed to ambient light;

an alarm annunciator;

a decoder means for detecting when a predetermined disarm code is entered onto said keypad and when a predetermined arm code is entered onto said keypad;

first alarm control means for preventing the actuation of said alarm annunciator when said decoder means detects that the last entry on said keypad was said disarm code;

a timer means enabled upon the initial detection of light by said photodetector for delivering a timeout signal upon the expiration of a predetermined period of time; and second alarm control means for enabling the actuation of said alarm annunciator upon the detection of said arm code being the last code entered onto said keypad and the detection of said timeout signal.

2. A portable personal article carrying security system as claimed in claim 1, wherein said decoder means further detects the entry of a code which is neither the arm code nor the disarm code so as to produce a tamper signal in response to such a detection.

3. A personal portable article carrying security system as claimed in claim 2, further comprising a third alarm control means for enabling said alarm annunciator in response to the output of said tamper signal by said decoder means.

4. A personal portable article carrying security system as claimed in claim 1, further comprising a flexible data bus located between said keypad and said decoder means, a flexible circuit board for housing at least said decoder, and wherein said keypad is also made of flexible material.

5. A personal portable article carrying security system as claimed in claim 1, wherein said alarm annunciator includes a tone generator for driving a buzzer when activated.

6. A personal portable article carrying security system as claimed in claim 1, further comprising an arm light activated upon the detection of said arm code by said decoder means and deactivated upon the detection of said disarm code by said decoder.

* * * * *